US006504459B1

(12) United States Patent
Ataiiyan et al.

(10) Patent No.: US 6,504,459 B1
(45) Date of Patent: Jan. 7, 2003

(54) PLANAR COUPLING OF SPHERICAL FERRITES

(75) Inventors: Younes Ataiiyan, Santa Rosa, CA (US); Brian Scott, Santa Rosa, CA (US); John Dunseth, Santa Rosa, CA (US); Ernest Nyiri, Bodega Bay, CA (US)

(73) Assignee: Microsource, Inc., Santa Rosa, CA (US)

( * ) Notice: Subject to any disclaimer, the term of this patent is extended or adjusted under 35 U.S.C. 154(b) by 14 days.

(21) Appl. No.: 09/888,285

(22) Filed: Jun. 21, 2001

(51) Int. Cl.[7] ..... H01P 7/00

(52) U.S. Cl. ..... 333/219.2; 333/219; 333/245

(58) Field of Search ..... 333/219.2, 245, 333/24.1, 204, 205, 219

(56) References Cited

U.S. PATENT DOCUMENTS 4,500,858 A * 2/1985 Mezak ..... 333/202
4,543,543 A * 9/1985 Blight et al. ..... 333/24.1
4,633,205 A * 12/1986 Jones ..... 333/219.2
6,255,918 B1 * 7/2001 Parrott et al. ..... 333/202
6,348,840 B2 * 2/2002 Ezura et al. ..... 331/96

* cited by examiner

*Primary Examiner*—Robert Pascal
*Assistant Examiner*—Dean Takaoka
(74) *Attorney, Agent, or Firm*—Townsend and Townsend and Crew LLP; Kenneth R. Allen

(57) ABSTRACT

A spherical resonator device includes a resonant sphere around which transducers for electrical coupling are metallized layers on a flat surface shaped to provide exposure of a sphere to a quasi constant field. In particular, the pattern comprises a transmission line of non-constant width in the region proximate to the sphere where a taper is provided which increases in width with distance from the sphere.

9 Claims, 2 Drawing Sheets

PLANAR COUPLING OF SPHERICAL FERRITES

BACKGROUND OF THE INVENTION

This invention relates to ferrite resonators and more particularly to coupling structures used with ferrite spheres.

A spherical ferrite is used as a resonator for building microwave tunable devices, such as oscillators, filters, limiters, and the like. In the past a complicated wire loop transducer is conventionally used to couple to the spherical ferrite resonator, which, in order to maximize coupling to the sphere, the transducer or transducers are in the shape of a half circle loop disposed around the sphere so that the wire is at roughly equal distance from the surface of the sphere. This configuration makes the assembly of these devices a time consuming task; making it almost impossible to implement an automated procedure for the purpose of high volume production of these components. What is needed is a configuration and structure to facilitate high volume manufacturability of spherical ferrite based devices.

BRIEF SUMMARY OF THE INVENTION

According to the invention, a spherical resonator device includes a resonant sphere around which transducers for electrical coupling are metallized layers on a flat surface shaped to provide exposure of the resonant sphere to a quasi constant field. In particular, the pattern comprises a transmission line of non-constant width in the region proximate to the sphere where a taper is provided which increases in width with distance from the sphere.

The invention will be better understood by reference to the following detailed description in connection with the accompanying drawings.

DESCRIPTION OF SPECIFIC EMBODIMENTS

Figure 1:
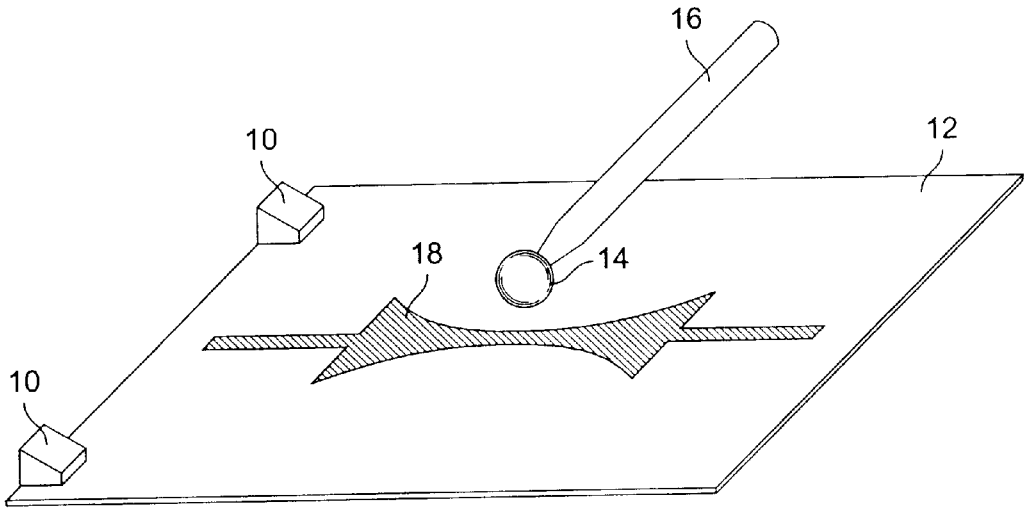
FIG. 1 is a perspective view of a layout of a first coupling showing placement of a resonating sphere according to the invention.

Reference is made to FIG. 1. Note that planar substrates, physical support structures, and supporting rods are not always shown, but it is to be understood that a transducer 18 is mounted on a planar substrate 12, which is supported by support structures 10, and that a resonating sphere 14 is suspended by a support rod 16 over the transducer 18. Alternatively, the resonating sphere may be mounted in an orifice between opposing sides of the planar substrate 12.

Figure 2:
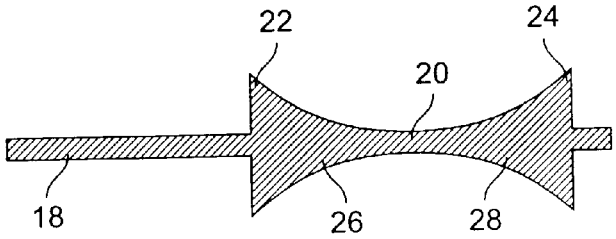
FIG. 2 is a top view of the layout of the first coupling.

FIG. 2 shows that the transducer 18 is a metallized layer having a non-constant width. The transducer 18 has a first region 20 having a minimum width, a second region 22 having a maximum width, and a third region 24 having a maximum width. A transition region 26 exists between the first region 20 and the second region 22. In the transition region 26, the width of the transducer 18 changes gradually from the minimum width of the first region 20 to the maximum width of the second region 22. A transition region 28 exists between the first region 20 and the third region 24. In the transition region 28, the width of the transducer 18 changes gradually from the minimum width of the first region 20 to the maximum width of the third region 24. The change of width in the transition regions 26 and 28 can resemble different mathematical function, including exponential functions.

Figure 3:
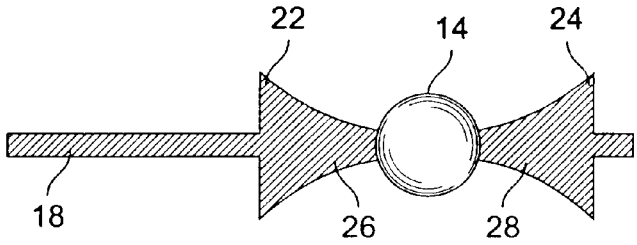
FIG. 3 is a top view of the layout of the first coupling showing placement of the resonating sphere.

FIG. 3 illustrates the placement of the resonating sphere 14 over the first region of the transducer 18. Following the contour of the transition regions 26 and 28, away from the resonating sphere 14, the gradually increasing width of the transducer 18, from the minimum width of the first region to the maximum widths of the second region 22 and the third region 24, compensates for the gradual increase in distance of the boundary of the transition regions 26 and 28 from the resonating sphere 14. The unique shape of the transducer 18 thus produces a quasi constant field to which the resonating sphere 14 is exposed.

Figure 4:
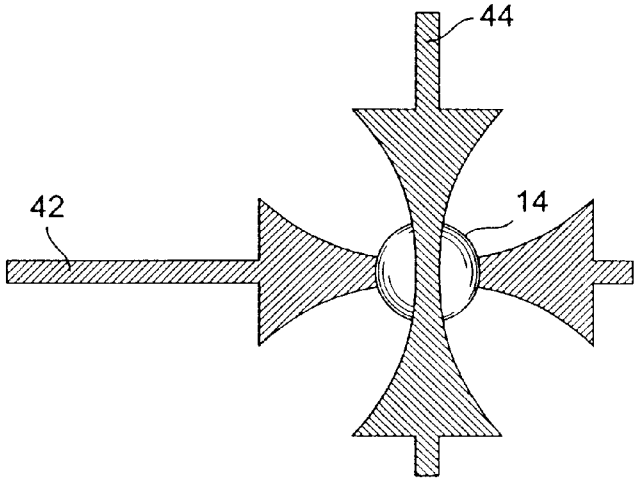
FIG. 4 is a top view of a dual coupling showing orthogonal patterns on either side of a sphere.

Referring to FIG. 4, dual coupling is achieved by the placement of the resonating sphere 14 between orthogonally positioned transducers 42 and 44. The transducers 42 and 44 are respectively mounted on separate planar substrates (not shown) that "sandwich" the resonant sphere 14. This dual coupling structure produces, among other things, bandpass filters and special oscillators.

Figure 5:
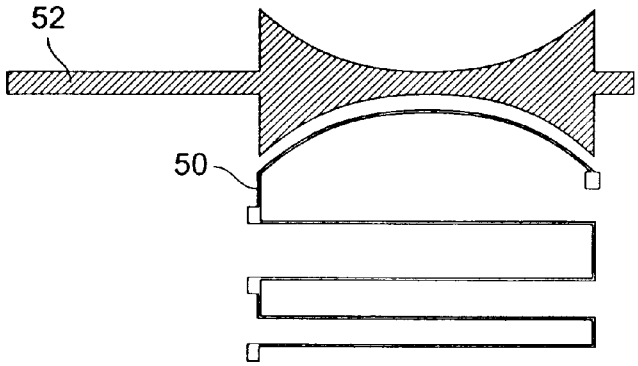
FIG. 5 is a top view of a single coupling showing a secondary resonant feedback coupling.

FIG. 5 shows a secondary resonant feedback coupling mechanism, which is achieved by mounting a trace 50 next to a transducer 52, on the same planar substrate. The unique flat-surface shape of the transducer 52 allows the trace 50 to easily be incorporated in the same plane as the transducer 52. The secondary resonant feedback coupling mechanism increases the operating bandwidth of the resonant sphere based device.

The invention has been explained with reference to specific embodiments. Other embodiments will be evident to those of ordinary skill in the art. It is therefore not intended that this invention be limited, except as indicated by the appended claims.

What is claimed is:

1. A spherical resonator device comprising:

a resonant sphere;

at least one transducer for electromagnetic coupling to said resonant sphere, said transducer comprising a flat metallized layer having a finite width shaped to provide exposure of the sphere to a quasi constant field, wherein said at least one transducer comprises a first region having a first width and a second region having a second width and a transition region between said first region and said second region, said first region being adjacent said resonant sphere, said first width being at a minimum, said second region being displaced radially from said resonant sphere, said second width being at a maximum, said transition region bridging between said first region and second region.

2. The device according to claim 1 wherein said transition region follows an exponential profile of increasing width from said first region to said second region, said profile being selected to compensate for decrease in field strength of coupling between said resonant sphere and said transducer and to enhance bandwidth of resonant coupling.

3. The device according to claim 1 further including a second transducer disposed orthogonally to said first transducer and on an opposing side of said resonant sphere.

4. The device according to claim 1 further including a secondary coupling comprising a trace disposed along said first transducer next to said first region and said second region.

5. A spherical resonator device comprising:

a resonant sphere;

at least one transducer for electromagnetic coupling to said resonant sphere, said transducer comprising a flat metallized layer having a finite width shaped to provide exposure of the sphere to a quasi constant field, wherein said at least one transducer comprises a first region having a first width, a second region having a second width, a third region having a third width, a first transition region between said first region and said second region, a second transition region between said first region and said third region, said first region being adjacent said resonant sphere, said first width being at a minimum, said second region being displaced radially from said resonant sphere, said second width being at a maximum, said third region being displaced radially from said resonant sphere and opposite said second region, said second width being at a maximum, said first transition region bridging between said first region and second region, and said second transition region bridging between said first region and third region.

6. The device according to claim 5 wherein said first transition region follows a first exponential profile of increasing width from said first region to said second region, said first exponential profile being selected to compensate for decrease in field strength of coupling between said resonant sphere and said transducer and to enhance bandwidth of resonant coupling, and wherein said second transition region follows a second exponential profile of increasing width from said first region to said third region, said second exponential profile being selected to compensate for decrease in field strength of coupling between said resonant sphere and said transducer and to enhance bandwidth of resonant coupling.

7. The device according to claim 6 wherein said second width is substantially equal to said third width, and said first exponential profile is substantially equal to said second exponential profile.

8. The device according to claim 5 wherein said second width is substantially equal to said third width.

9. The device according to claim 5 further including a secondary coupling comprising a trace disposed along said first transducer next to said first region, said second region, and said third region.

* * * * *